US006065900A

United States Patent [19]

Reale

[11] Patent Number: 6,065,900

[45] Date of Patent: May 23, 2000

[54] COLLAPSIBLE BOLLARDS

[76] Inventor: George Reale, 3444 Marshall Rd., Drexel Hill, Pa. 19026

[21] Appl. No.: 09/211,632

[22] Filed: Dec. 15, 1998

Related U.S. Application Data

[60] Provisional application No. 60/069,512, Dec. 15, 1997.

[51] Int. Cl.[7] ..... E01F 13/08

[52] U.S. Cl. ..... 404/6; 49/35; 49/49

[58] Field of Search ..... 404/6, 9; 49/35, 49/49, 131

[56] References Cited

U.S. PATENT DOCUMENTS

| | | | |
|---|---|---|---|
| D. 324,920 | 3/1992 | Miller et al. | D25/126 |
| D. 336,346 | 6/1993 | Miller et al. | D25/123 |
| 3,925,929 | 12/1975 | Montgomery | 49/35 |
| 5,018,902 | 5/1991 | Miller et al. | 404/6 |
| 5,248,215 | 9/1993 | Fladung | 404/6 |
| 5,441,359 | 8/1995 | Filippi | 404/6 |
| 5,895,169 | 4/1999 | Holm et al. | 404/9 |

*Primary Examiner*—James A. Lisehora
*Attorney, Agent, or Firm*—William L. Muckelroy; Gary Lipson

[57] ABSTRACT

As improved collapsible bollard is disclosed to control vehicular traffic. The present invention is comprised of a base that has at least one bore, a carriage having at least one bore that corresponds to the bore in the base. There is at least one impact release insert. The impact release insert is seated in the bore of the base. A fastening means is used to secure the impact release insert and the carriage to the base. A sleeve is removably fastened to the carriage. The sleeve has a free floating insert lock, a bias means, and a pulley system. The bias means of the sleeve is positioned to cause a downward bias against the free floating insert lock. The free floating insert lock is attached to the pulley system such that said pulley system is able to move the free floating insert lock in a direction that is opposite to the bias means. In the event the present invention is struck extremely hard, the sleeve will shear from base and the sleeve will typically be unharmed mechanically.

14 Claims, 6 Drawing Sheets

COLLAPSIBLE BOLLARDS

Applicant claims priority of date of Dec. 15, 1997 based on a pending patent application having the Ser. No. 60/069,512.

FIELD

The present invention relates to apparatus for controlling vehicular traffic, and more particularly, to devices for providing collapsible obstructions or collapsible bollards that are constructed in a modular design to control such traffic.

BACKGROUND

Numerous sites, such as universities, pedestrian walkways, government buildings, sports stadiums, military bases, amusement parks, industrial parks, airports, parking lots, playgrounds, shopping centers, malls, hospitals, and apartment complexes have transitways such as roadways, walks, or other open areas from which it is desirable to prevent the flow of vehicular traffic. However, it is imperative that authorized vehicles, particularly emergency vehicles, be allowed entry access to such areas via these transitways.

For example, a university may wish to prohibit vehicular traffic from passing through campus, but has to permit fire and other emergency vehicles access to the campus in an expedient manner. Typically the university will address the provisional access issue by erecting barriers such as chains or gates, eventhough there are numerous disadvantages to such solutions. Gates and chains impede pedestrian traffic and the gate may also pose a safety problem. Moreover, locks or other devices that are used to secure the gates or chains are susceptible to malfunction especially during the winter months. It should also be noted that in the event a lock is used, then keys must be provided to fire and police personnel. It is not uncommon to find that keys are not available or that locks have been changed which could result in a possibly life-threatening delay.

Similarly, portable wooden barricades are an ineffective solution, since two persons are required in order to erect and move them. Portable wooden barricades suffer from an additional disadvantage in that the wooden barriers may be moved or removed by anyone.

As an alternative to gates and chains, rows of fixed spaced posts or bollards may be installed. Fixed bollards permit access by vehicles and allow pedestrians free access, however, their permanence creates an unacceptable barrier to emergency vehicles and an inconvenience to other authorized vehicles. The prior art discloses bollards that are collapsible as seen in U.S. Pat. No. 5,018,902 issued to Miller, et al. on May 1, 1991. However, the Miller patent still suffers having a complicated internal locking structure and the device is subject to expensive and lengthy repairs in the event of damage.

Thus there exists a need for a highly effective collapsible bollard design that permits an efficient and economical control of traffic, yet is economical to produce and easily maintained.

OBJECTS

It is therefore an object of the present invention to provide bollards which may be easily collapsed by authorized personnel using a standard fire hydrant wrench, yet which may be locked securely by anyone in an obstructing position to control vehicular access to a transitway.

It is another object of this invention to substitute for more cumbersome barriers such as locks and chains. It is another object of the present invention to be adaptable many bollard in ground bases that already exist in the marketplace.

It is another object of the present to provide a maintenance serviceable unit together with a complete, cost-efficient line of replacement parts.

It is a further object of the present invention to provide bollard constructed such that regular maintenance staff could repair a disabled unit in about eight (8) minutes to fifteen (15) minutes.

It is a further object of the present invention to provide bollards having self-contained locking mechanisms which are sturdy, reliable and protected from the elements.

It is also an object of certain embodiments of the present invention to provide collapsible bollards having apparatus for re-locking the collapsed bollard in an obstructing position without the use of tools.

SUMMARY

It has now been discovered that an apparatus comprised of the following elements accomplishes these and other objects of the present invention. A base that has at least one bore defined therein. A carriage having at least one bore defined therein that corresponds to the bore that is defined in the base. There is at least one impact release insert. The impact release insert is received by the bore that is defined in the base. The impact release insert also has a hole defined therein. A fastening means which secures the impact release insert and the carriage to the base. A sleeve is removabley fastened to the said carriage. The sleeve has a free floating insert lock, a bias means, and a pulley system. The bias means of the sleeve is positioned to cause a downward bias against the free floating insert lock. The free floating insert lock is attached to the pulley system such that said pulley system is able to move the free floating insert lock in a direction that is opposite to the bias means.

PARTS LIST

1. Lower base plate
2. Base tube
3. Upperbase plate
4. Female aluminum part
5. Male aluminum part
6. Cover plate
7. Compression spring
8. Bracket
9. Cable
10. Axle
11. Sleeve
12. Release insert cup
13. Hydrant nut
14. Hub
15. Upper tube
16. Socket cap screw
17. Socket set screw
18. Eye bolt with washer nut

BRIEF DESCRIPTION OF DRAWINGS

These and other features, aspects, and advantages of the present invention will become better understood with regard to the following description, appended claims, and accompanying drawings where:

DETAILED DESCRIPTION

The present invention will be described hereinafter with reference to the accompanying drawings which illustrate an embodiment of the invention.

Figure 1:
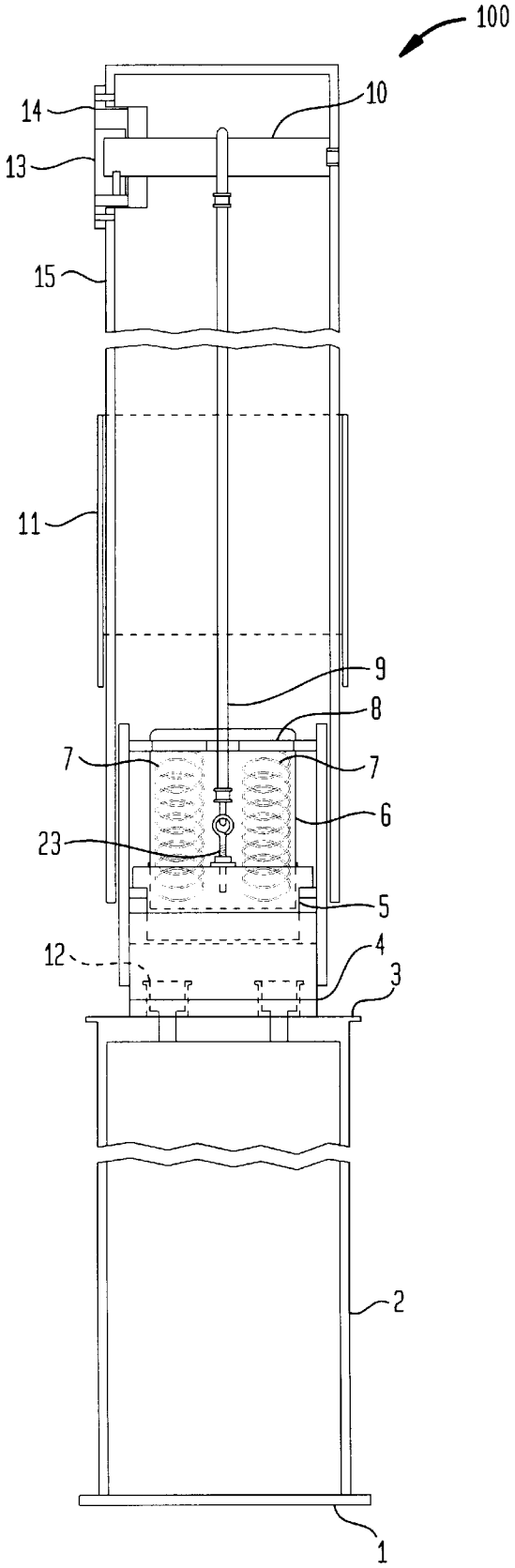
FIG. 1 is a front cross sectional view of the present invention.

The need for a cost efficient, serviceable and dependable bollard that challenges the rigorous demands for through traffic control is fulfilled by having a permanent base and mechanism that permits the above ground portion to lay flush on the ground in both a forward and backward direction. In FIG. 1 the present invention is represented generally by numeral 100. It is contemplated that the base tube 2 can be made out any hardened material such as metal or plastic. A lower base plate 1 is secured to one end of the base tube 2 and an upper base plate 3 is secured to another end of the base tube 2. It is contemplated that when the apparatus 100 is installed the base tube 2 is securely anchored in the ground. In this embodiment, a female part is formed of a hardened material such as metal or plastic. The female part 4 defines a first set of two bores therethrough. The two bores have a lip at one end such that release insert cups 12 can be placed within the two bores and the release insert cups can be held securely in place. Screws or other fastener means are placed through the release insert cups 12 and secured to the upper base plate 3, base tube 2 combination The female part 4 has a cavity defined therein.

A sleeve 15 contains a male part 5, two springs 7, a cable 9, and an axle 10. The male part 5 has a top and a bottom. There are two springs 7 that are fixed at one end and secured at the other end to the top of the male part 5. The springs 7 are positioned urge the male part in a downward direction. The male part 5 has a ridge defined on the bottom such that the ridge may be accepted into the cavity of the female part 4 such that the sleeve 15 is held in a fixed position relative to the female part 4. The axle is rotably secured at a point above the springs 7. A cable 9, or other flexible connector, is secured at one end to the axle and at the other end to the male part 5. The axle can be rotated to shorten the cable 9. This rotational action results in an upward bias against the springs 7. The upward bias causes the male part 5 to disengage from the female part 4 such that the sleeve is free to move in a forward or backward direction. One end of the axle is exposed to the outside of the sleeve 15. The exposed end of the axle is the shape of a hydrant nut 13. It is contemplated that once the device is in the upright, locked position, that the apparatus can only be disengaged and otherwise collapsed through the use of personnel with a fire hydrant wrench.

Figure 2:
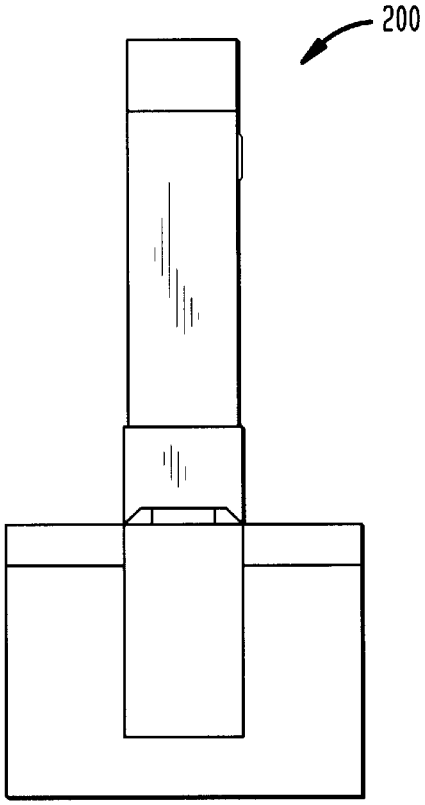
FIG. 2 is a view of the present invention in use.
Figure 3:
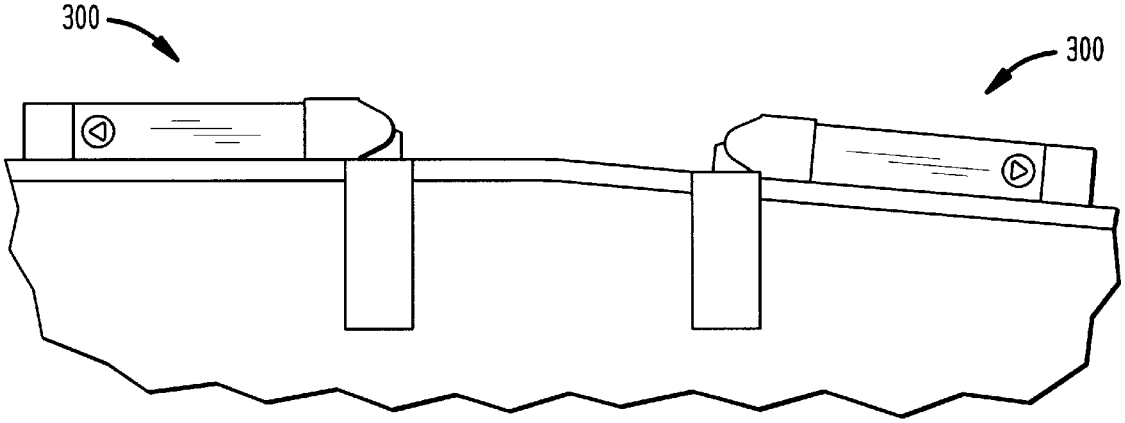
FIG. 3 includes two views of the present invention in a collapsed state.
Figure 5A:
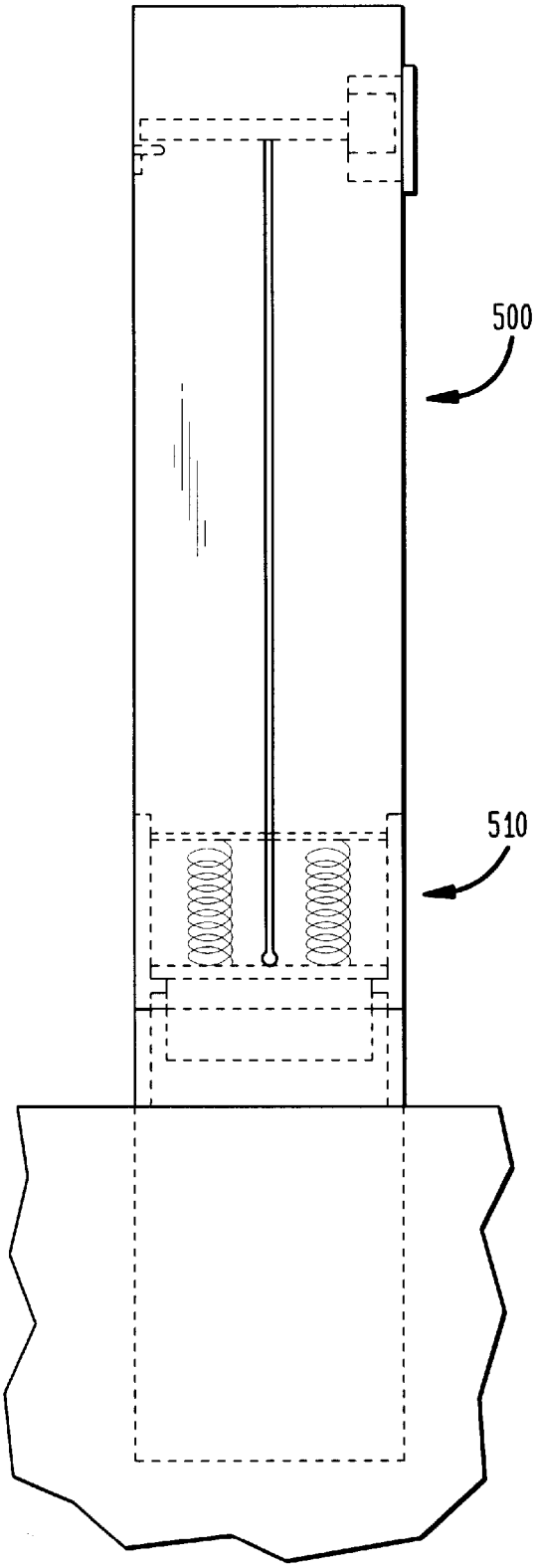
FIG. 5*a* is a front view of the present invention having a concrete base installed in the ground.
Figure 5B:
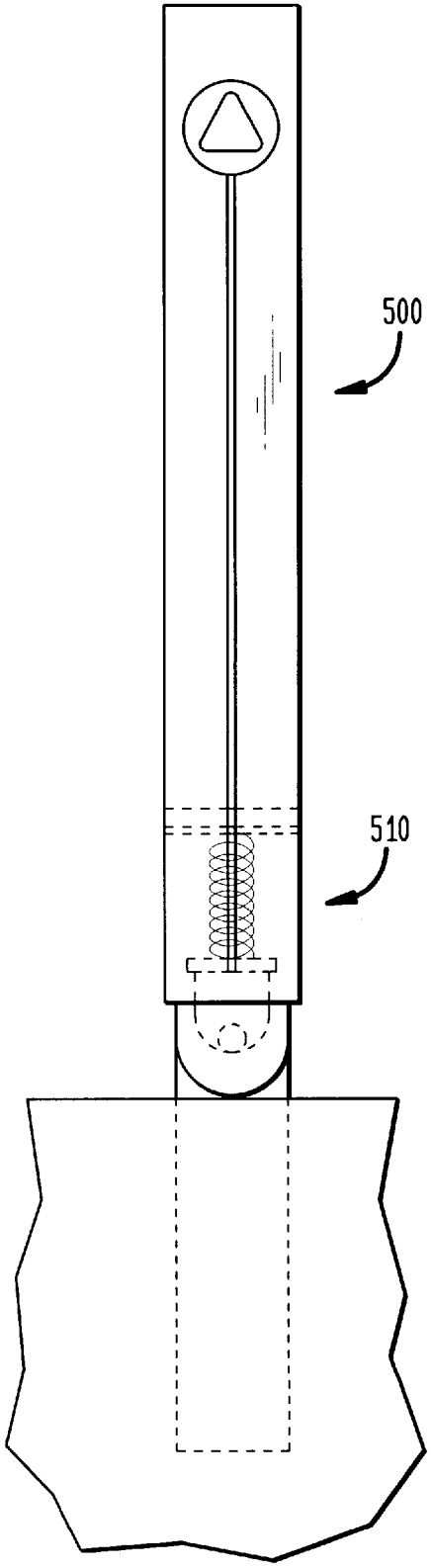
FIG. 5*b* is a side view of the present invention having a concrete base installed in the ground.
Figure 6:
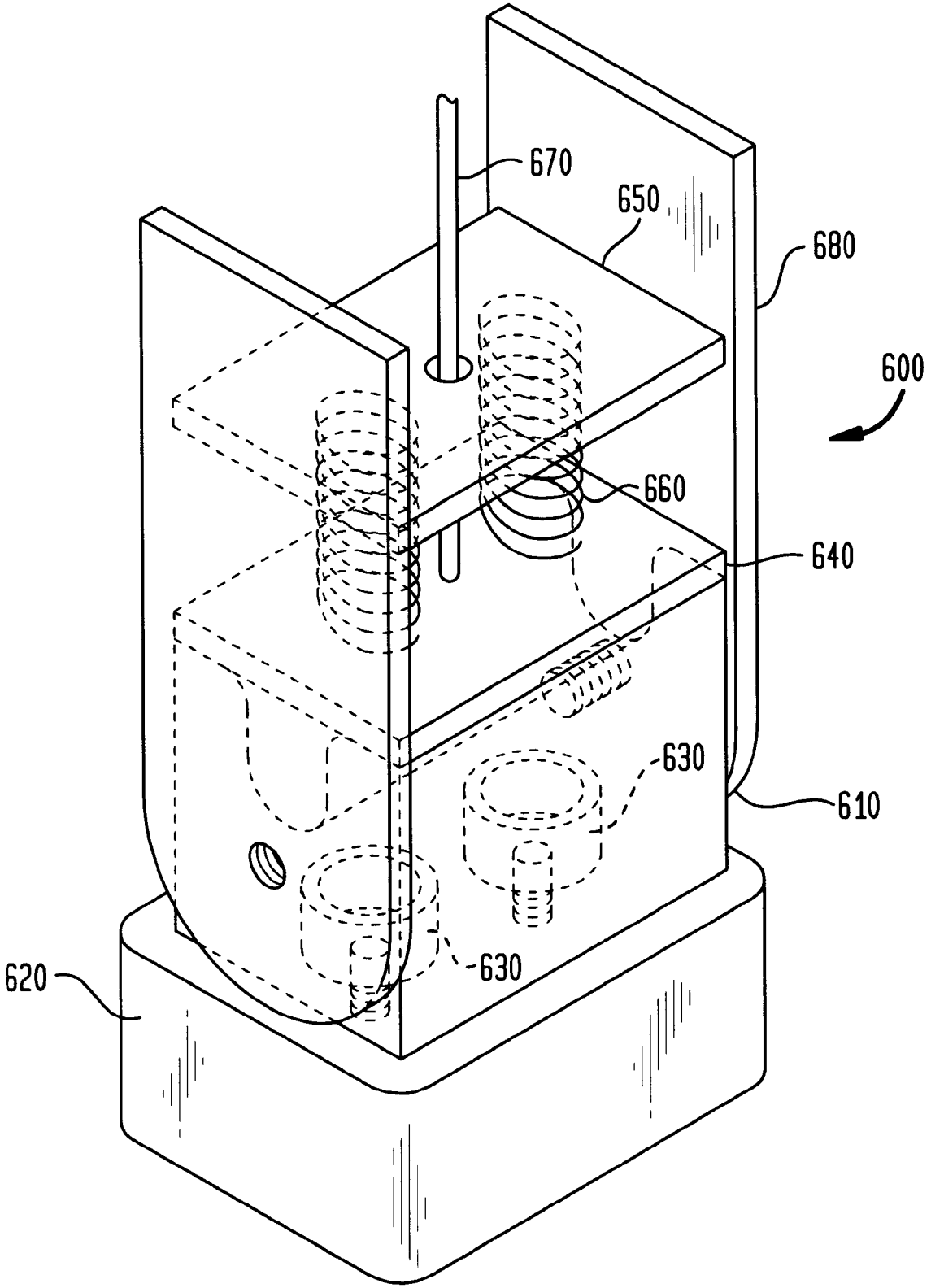
FIG. 6 is perspective view of the a section of the present invention that includes the male part, the female part, and the bias means that is positioned to urge the male part into the female part.
Figure 7A:
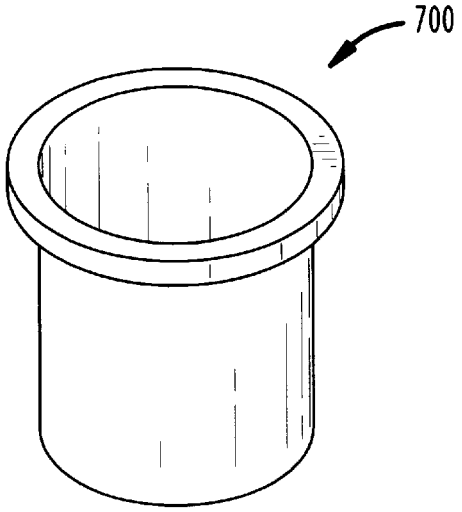
FIGS. 7*a*–7*d* are perspective view of the release insert cup that may be included as an element in the present invention.
Figure 7B:
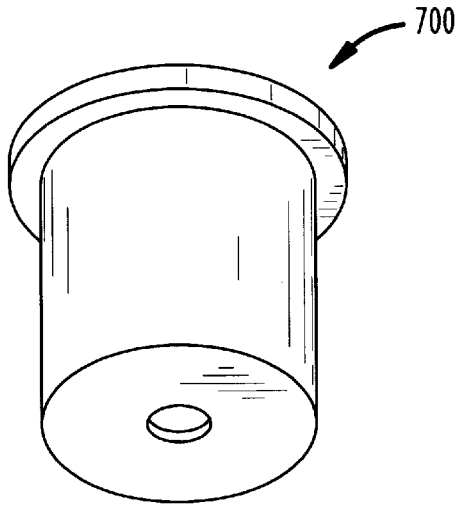
Figure 7C:
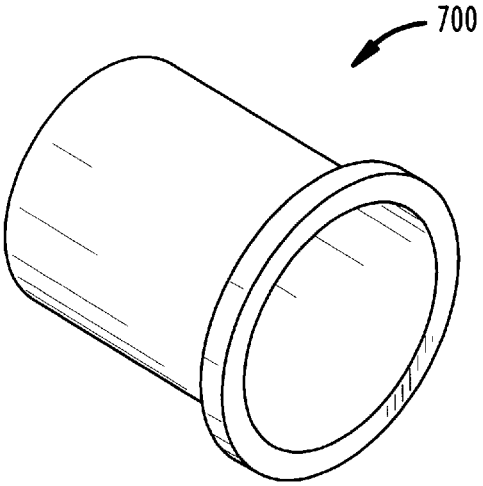
Figure 7D:
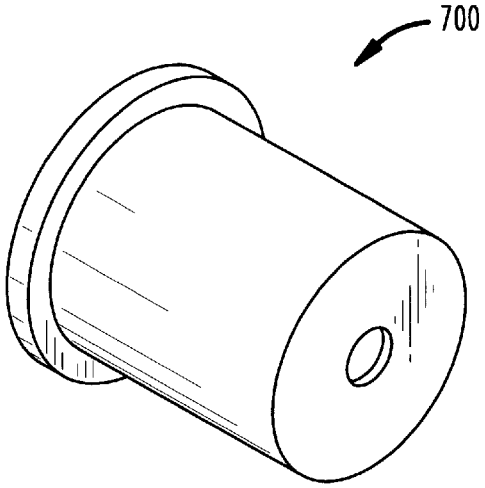

FIGS. 2, 3 and 5 show the present invention in various configurations. FIG. 2 shows a front view of the present invention in which the base tube is secured below grade at a distance of approximately 18 inches. FIG. 3 shows an embodiment of the present invention in which the present invention is in the collapse state and laying in either a forward or backward position. In FIG. 5, the present invention is depicted showing the apparatus in an upright and locked position such the base of the present invention is secured below grade. FIG. 5 clearly identifies one embodiment of the locking means 510 which includes a male part, a female part, and springs.

Figure 4A:
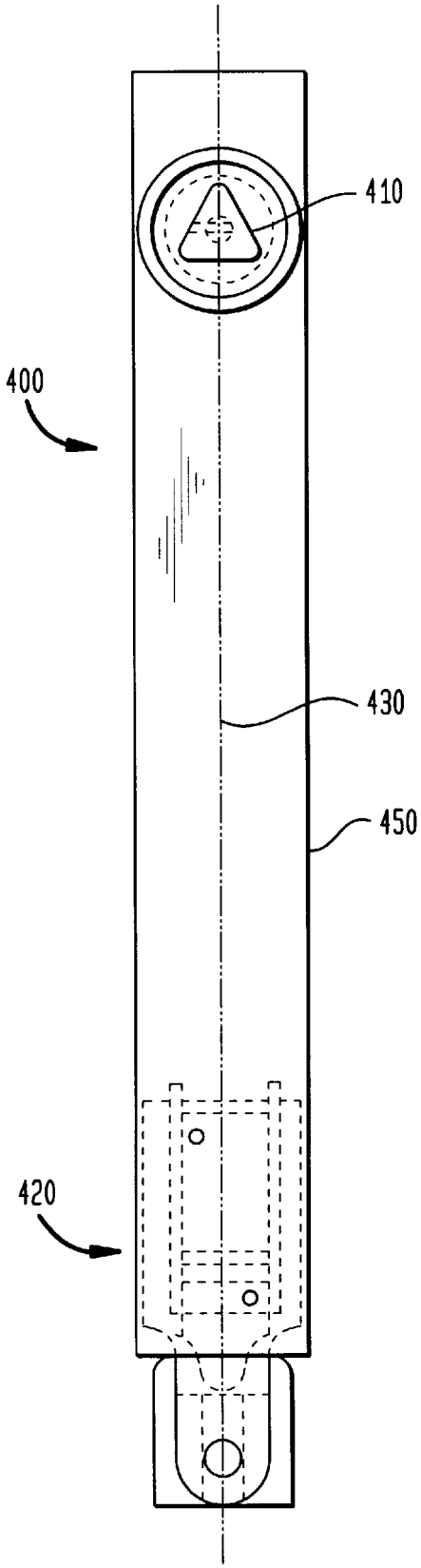
FIG. 4*a* is a side perspective view of the present invention.
Figure 4B:
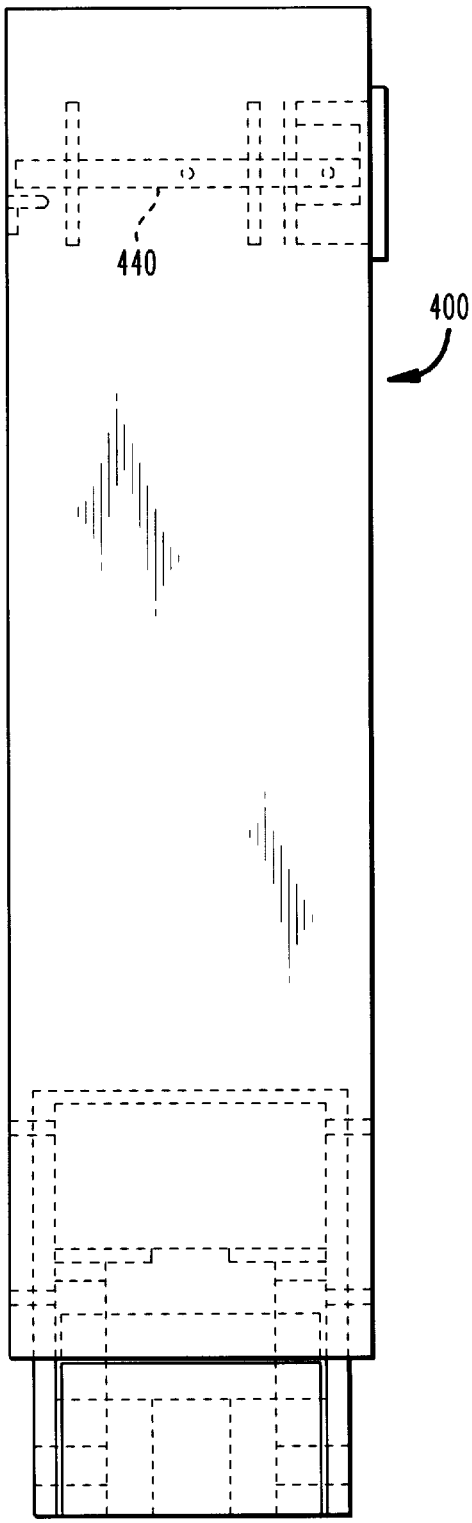
FIG. 4*b* is a front cross section view of the present invention.

FIG. 4 depicts an above grade front view and side view of the present invention. A cable 430 is attached to an axle 440 at one end and a male part at another end. A hydrant nut 410 is attached to an integral with one end of the axle 440. The hydrant nut 410 is axially rotated causing the axle to rotate. The rotation of the axle 440 causes the cable 430 to shorten and raise the male part. The raising of the male part permits the sleeve 450 to move in either a forward or backward direction.

FIG. 7 is represented generally by numeral 600. FIG. 7 is an expanded view of one embodiment of elements of locking means and a depiction of the connection between the female part 610 and the base tube. The release insert cups 630 are seated in the inside portion of the female part 610. A fastening means is threaded holding the release insert cups against the female part 610 and securing the female part 610 to the base tube 620. Springs 660 are held in position between the bottom of a fixed plate 650 and the top of the male part 640. The springs 660 cause a downward bias and essentially lock the male part 640 into the female part 610. A cable 670 is secured to the top of the male part 640 so that the male part can be disengaged from the female part by authorized personnel. When the male part is disengaged from the female part 610 the sleeve or carriage is free to move in either a forward or backward direction.

FIG. 7*a* through 7*d*, depicts various perspective views of the release insert cup. It is contemplated that the release insert cup be formed of a material that has sufficient strength to hold up the apparatus. However, the material is expected to shear in the event an extreme force is applied against the material, such as where the apparatus were to be struck by a motor vehicle. It is contemplated that allowing the release insert cup to shear will minimize damage to the above grade portion of the present invention and virtually protect the below grade portion of the present from any material damage.

What is claimed is:

1. A collapsible bollard comprising:

a base, said base defining at least one bore therein;

a carriage defining at least one bore therein corresponding to said at least one bore defined in said base;

at least one impact release insert, said at least one impact release insert received by said one bore defined in said base; said at least one impact release insert having a hole defined therein;

a fastening means securing said at least one impact release insert and said carriage to said base; and a sleeve removably fastened to said carriage, said sleeve having a free floating insert lock, a bias means, and a pulley system, said bias means is positioned to cause a downward bias against said free floating insert lock, said free floating insert lock is attached to said pulley system such that said pulley system is able to move said free floating insert lock in a direction opposite to said bias means.

2. A collapsible bollard comprising:

a base tube having a top and a bottom;

a lower base plate secured to the bottom of said base tube;

an upper base plate secured to the top of said base tube;

a female part having a top and a bottom, the bottom of said female part is frangibly secured to said upper base plate and said base tube, the top of said female part defines a ridge therein;

a sleeve pivotally connected to said female part, said sleeve containing a male part, a bias means is positioned to urge said male part in a downward direction and received by said ridge, said male part seats securely in said ridge such that said male part is securely locked into position; and an upward means for urging the male part in an upward direction such that the male part is disengaged from the female part and said sleeve is free to move in a forward and a reverse direction.

3. A collapsible bollard as claimed in claim 2, further including said female part having at least one bore, at least one release insert cup defining a cavity therein and a bore therethrough, said at least one release insert cup is securely seated in said bore of said female part, a securing means secures each of said at least one least one release cup to said upper base plate and said base tube.

4. A collapsible bollard as claimed in claim 3, wherein said release insert cup is constructed to shear as a result of significant impact to said sleeve, such that said lower base plate, said base tube, and base upper base plate remain undamaged.

5. A collapsible bollard as claimed in claim 3, wherein said upward means includes:

an axle, said axle rotably installed in a horizontal direction at a point above said male part, a flexible connector having a first end and a second end, the first end of said flexible connector is secured to said axle and the second end of said axle having a first end and a second end, said first end of said axle extending through said sleeve, said first end of said axle forms a fire hydrant bolt such that said fire hydrant wrench results in rotation of said axle; and rotation of said axle translates into an upward movement of said male part, which unlocks the male part from the female part and permits forward and backward movement of said sleeve.

6. A collapsible bollard as claimed in claim 5, wherein the bias means includes at least one spring, said spring having a first end and a second end, the first end of said at least one spring fixed at a position above the male part, said male part having a top and a bottom, said bottom of said at least one spring is secured to said top of said male part.

7. A collapsible bollard as claimed in claim 6, wherein said flexible connector is a steel cable.

8. A collapsible bollard comprising:

a base tube;

a fastening means and a female part, said female part is connected to said base tube by said fastening means; said female part having a cavity defined therein; and a sleeve having a male part and a downward bias; said sleeve is pivotally secured to the female part; said male part received by said female part; and a downward bias positioned to maintain said male part in a downward position locking said sleeve in an upright position.

9. A collapsible bollard as claimed in claim 8, wherein said base tube is composed of a hardened material and said base tube is permanently anchored in place.

10. A collapsible bollard as claimed in claim 9, wherein said fastening means includes an impact release insert, said female part defines at least one bore therethrough, said male part defines at least one bore corresponding in location said at least one bore defined in said female part, said impact release cup is received by said one bore defined in said female part, said impact release cup is secured such that said female part is secured to said male part.

11. A collapsible bollard as claimed in claim 10, wherein said release insert cup is constructed to shear as a result of impact to the device; said release impact cup is constructed to shear by applying any force that is equal to or greater than a force necessary to cause damage to said base tube and to said sleeve.

12. A collapsible bollard as claimed in claim 11, wherein said male part includes a ridge, said downward bias urges said male part in a downward direction, said ridge is received by said female part causing said male part to be locked in position.

13. A collapsible bollard as claimed in claim 12, wherein said sleeve includes an axle and a cable, said cable having a first end and a second end, said first end is connected to said axle and said second end is connected to said downward bias, said axle is rotably attached to said sleeve, rotation of said axle causes said male part to be disengaged from said female part permitting said sleeve to pivot in a forward or backward direction.

14. A collapsible bollard as claimed in claim 13, wherein said axle has a first end and a second end, said first end of said axle forms a fire hydrant bolt such that said axle may only be rotated by a fire hydrant wrench.

* * * * *